US006821189B1

(12) United States Patent
Coad et al.

(10) Patent No.: US 6,821,189 B1
(45) Date of Patent: Nov. 23, 2004

(54) ABRASIVE ARTICLE COMPRISING A STRUCTURED DIAMOND-LIKE CARBON COATING AND METHOD OF USING SAME TO MECHANICALLY TREAT A SUBSTRATE

(75) Inventors: Eric C. Coad, Woodbury, MN (US); David G. O'Neill, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/687,020

(22) Filed: Oct. 13, 2000

(51) Int. Cl.[7] ..... B24B 1/00

(52) U.S. Cl. ..... 451/41; 451/530; 451/527; 451/56

(58) Field of Search ..... 451/56, 530, 533, 451/41, 527, 534, 539; 51/298, 295, 293, 306, 398

(56) References Cited

U.S. PATENT DOCUMENTS

| | | | | |
|---|---|---|---|---|
| 4,663,890 A | * | 5/1987 | Brandt | 451/41 |
| 4,735,632 A | | 4/1988 | Oxman et al. | |
| 4,974,373 A | | 12/1990 | Kawashima et al. | |
| 5,078,848 A | | 1/1992 | Anttila et al. | |
| 5,107,626 A | | 4/1992 | Mucci | |
| 5,152,914 A | | 10/1992 | Forster et al. | |
| 5,152,917 A | | 10/1992 | Pieper et al. | |
| 5,175,030 A | | 12/1992 | Lu et al. | |
| 5,183,597 A | | 2/1993 | Lu | |
| 5,307,593 A | | 5/1994 | Lucker et al. | |
| 5,401,543 A | | 3/1995 | O'Neill et al. | |
| 5,435,816 A | | 7/1995 | Spurgeon et al. | |
| 5,551,959 A | | 9/1996 | Martin et al. | |
| 5,643,343 A | | 7/1997 | Selifanov et al. | |
| 5,658,184 A | | 8/1997 | Hoopman et al. | |
| 5,690,705 A | * | 11/1997 | Holmes et al. | 51/295 |
| 5,707,409 A | * | 1/1998 | Martin et al. | 51/295 |
| 5,711,773 A | * | 1/1998 | Selifanov et al. | 51/306 |
| 5,733,178 A | | 3/1998 | Ohishi | |
| 5,928,394 A | * | 7/1999 | Stoetzel | 51/295 |
| 5,946,991 A | | 9/1999 | Hoopman | |
| 5,949,612 A | | 9/1999 | Gudeman et al. | |
| 6,087,025 A | * | 7/2000 | Dearnaley et al. | 428/623 |
| 6,241,588 B1 | * | 6/2001 | Brown et al. | 451/56 |
| 6,277,160 B1 | * | 8/2001 | Stubbs et al. | 51/293 |
| 6,447,374 B1 | * | 9/2002 | Sommer et al. | 451/56 |

FOREIGN PATENT DOCUMENTS

| | | |
|---|---|---|
| EP | 1 038 637 A2 | 9/2000 |
| JP | 5-228845 | 9/1993 |
| WO | WO 96/29697 | 9/1996 |
| WO | WO 97/07503 | 2/1997 |
| WO | WO 99/43491 | 9/1999 |
| WO | WO 99/61167 | 12/1999 |

OTHER PUBLICATIONS

"Lost data: How a little dirt can do a lot of damage", by LiHong Zhang and Ramesh Koka, Mar. 1999, *Data Storage*, pp. 15, 16, 18, and 20.

"Only clean drives are good drives", by Peter Mee, Martin Smallen, Susan tong, and Afaf Wensky, Sep. 1997, *Data Storage*, pp. 77, 78, and 80.

Pamphlet from Exclusive Design Company, Inc. (EDC), "1800A Automated Surface Finisher", Copyright 1996.

Pamphlet from Exclusive Design Company, Inc. (EDC), "800F Hard Disk Finisher", Copyright 1996.

* cited by examiner

*Primary Examiner*—Hadi Shakeri

(57) ABSTRACT

The invention provides abrasive articles comprising: (a) a backing having a first major surface and a second major surface; and (b) an abrasive coating consisting essentially of: (i) a hardened binder coating having a first surface adhered to the flexible backing and a second structured surface comprising a plurality of precisely-shaped protrusions; and (ii) a diamond-like carbon coating superposed and adhered to at least a portion of the structured surface of the hardened binder coating. Also reported is a method of mechanically treating a rigid disk or a rigid disk substrate using the abrasive articles of the present invention.

30 Claims, 4 Drawing Sheets

ABRASIVE ARTICLE COMPRISING A STRUCTURED DIAMOND-LIKE CARBON COATING AND METHOD OF USING SAME TO MECHANICALLY TREAT A SUBSTRATE

BACKGROUND

Personal computers have become commonplace in the modern workplace. Many personal computers contain a rigid memory disk or hard drive. A hard drive involves a rigid metal or non-metal disk as the substrate of the magnetic medium. In one conventional arrangement, the thin film rigid disks are manufactured by electroless nickel plating a thin-film of nickel or nickel alloy (e.g., nickel/phosphorous, Ni-P) onto an aluminum base. The Ni-P coating is then polished to a very fine, mirror-like finish. After polishing, the Ni-P coating is textured, followed by the application of a magnetic coating(s) thereon to form the magnetic medium. However, nonmetal substrates, such as glass or ceramic substrates, also are used in the rigid memory disk industry in place of the metal substrates. For these nonmetallic substrates, there is no metal or metal alloy coating applied onto the substrate before subsequent polishing, texturing and magnetic coating application. Rather, the surface of the glass or ceramic rigid disk itself is polished, textured, and thereafter the magnetic coating is directly applied thereon without interposing any metal or metal alloy coating layer.

The texturing portion of this process is critical to the performance of the rigid disks. Texturing accomplishes a number of purposes. For example, texturing improves the magnetic properties of the coated disks. The scratches formed during texturing are critical to reducing the magnetic domain size thereby increasing the disk storage capacity. A textured surface also reduces the static friction between the head (which reads and writes data on the disk) and the disk. When the computer is turned on and energized, the rigid disk will begin to spin. If the disk is smooth and untextured, this head/disk contact makes it difficult for the disk to start spinning. This is known in the computer industry as stiction/friction. Finally, texturing may improve the aerodynamics between the head and the thin film rigid disk as the disk spins beneath the head.

The texturing process is traditionally accomplished by using a loose abrasive slurry. The loose abrasive slurries provide substantially circumferential scratches that have sharply defined edges having the requisite depth. Loose abrasive slurries are, however, accompanied by a number of disadvantages. For instance, the loose abrasive slurries create a large amount of debris and waste. As a result, the thin film rigid disks must be thoroughly cleaned to remove any residues left on their surface from the binder precursor. Also, abrasive particles from the abrasive slurry may become embedded in the surface of the rigid disks which may cause damage to the sensitive MR heads used in modern disk drives. Finally, the loose abrasive slurry also results in a relatively high amount of wear on the equipment used for texturing.

To overcome the disadvantages associated with loose abrasive slurries, coated abrasive lapping tapes have been used to texture the thin film rigid disks. An example of such a product is "IMPERIAL" Lapping film (Type R3) commercially available from 3M Company, St. Paul, Minn. This lapping film comprises a polymeric film backing having an abrasive coating layer bonded thereto. The abrasive coating layer consists of very fine abrasive particles (average particle size less than 10 micrometers) dispersed in a binder and coated on the polymeric film to form a thin layer (about 10–15 micrometers). The surface profile of the abrasive coating is essentially flat other than the partial protrusions formed by some of the fine abrasive particles. During use, the lapping film abrades a portion of the substrate surface, thereby texturing the surface of the substrate. Similarly, U.S. Pat. No. 4,974,373 to Kawashima et al. describes an abrasive tool suited for use in lapping, polishing, texturing, and various other finishing of precision machine parts, mentioning hard disks, magnetic heads, ceramics, plastics, and jewels. The tool is formed from abrasive powder particles fixed in a separated proximity to each other in a binder resin coat as a continuous monolayer disposed on a plastic film base. Japanese laid-open application no. 5-228845 of Tokyo Magnetic Printing Co. Ltd, published on Sep. 7, 1993, discloses a texturing polishing film for magnetic disk substrates, where the polishing film involves abrasive particles retained on a plastic film or nonwoven fabric tape with a water soluble resin, preferably as a single particle layer.

The portion of the substrate abraded away during texturing is known in the industry as swarf. Practice has shown that swarf generated during the use of such lapping films having sealed backings and nonstructured abrasive coatings is still apt to be present at the interface of the abrasive coating and the substrate work surfaces. Therefore, there remains some opportunity for the swarf to become attached to the high spots on the textured rigid substrate where lapping films are employed. That particular phenomenon is known in the industry as reweld. Those high spots are highly undesirable as they can collide with the computer head during use, which can cause a loss of data and/or head damage as a result of the collision.

In addition to the problems with reweld, the lapping film may not provide scratches having edges as sharp and/or clean as those produced by the loose abrasive slurries. These lower quality scratch edges may degrade the quality of the disks manufactured using lapping film for the texturing process.

The use of structured abrasive articles has been described recently where abrasive composites are formed on flexible backings in the form of rows of aligned individual abrasive composites or as elongate ridges of abrasive material. For instance, U.S. Pat. No. 5,152,917 (Pieper et al.) discloses structured abrasive articles with abrasive composites that are precise three-dimensional shapes extending from the backing. Recesses or channels are left between the abrasive composite shapes to facilitate the discharge of swarf from the abrasive article and thereby reduce loading. Pieper et al. do not disclose the use of their abrasive article for texturing and/or buffing rigid disks.

Also, U.S. Pat. No. 5,107,626 (Mucci) describes a method for treating a workpiece by a structured abrasive article to produce a precise pattern on the workpiece surface, where the workpiece is described as any solid material. The examples of solid materials given by Mucci include metal and metal alloys, such as carbon steel, stainless steel, high nickel alloys and titanium, as well as other disparate surfaces such as plastic, painted surfaces, ceramics, wood, marble, stone and the like. Mucci, like Pieper et al., does not report the use of the abrasive article for texturing and/or buffing rigid disks.

U.S. Pat. No. 5,733,178 (Ohishi) reports a method for texturing magnetic recording media substrates using a structured abrasive article including a flexible backing having a major surface and an abrasive coating including a plurality of precisely-shaped three-dimensional abrasive composites.

The abrasive composites comprise a plurality of abrasive particles dispersed in a binder which binder provides the means for attachment of the composites to the backing.

SUMMARY

The present invention provides a method of mechanically treating a substrate, the method comprising the steps of:

(a) providing a substrate for mechanical treatment, the substrate selected from the group consisting of a rigid disk or a rigid disk substrate;

(b) providing an abrasive article in contact with the substrate at a pressure, the abrasive article comprising:
- a backing having a first major surface and a second major surface; and
- an abrasive coating consisting essentially of:
  - a hardened binder coating having a first surface adhered to the flexible backing and a second structured surface comprising a plurality of precisely-shaped protrusions; and
  - a diamond-like carbon coating superposed and adhered to at least a portion of the structured surface of the hardened binder coating; and (c) moving at least one of the substrate and the abrasive article relative to the other to provide the mechanical treatment.

The present invention provides a method of mechanical treatment of a substrate wherein mechanical treatment is used broadly to include the processes of texturing, buffing, or cleaning. "Texturing" as used herein refers to the process of generating scratches in a rigid disk substrate prior to the application of the magnetic coating(s) to the rigid disk substrate. "Buffing" as used herein refers to the process of removing asperities in the surface of the rigid disk or rigid disk substrate. "Cleaning" as used herein refers to the process of removing contamination, for example, particulate contamination, from the surface of the rigid disk or rigid disk substrate without altering the surface topography of the rigid disk or rigid disk substrate.

In an embodiment of the method of the present invention, the substrate is a rigid disk substrate comprising a metal base having opposite major surfaces and a metal coating formed on at least one of the major surfaces. In another embodiment, the substrate is a rigid disk substrate comprising glass or ceramic. In another embodiment of the method of the present invention, the substrate is a rigid disk.

In another embodiment, the substrate is circular having a center and wherein step (c) comprises rotating the substrate about the center to form substantially circumferential scratches in the substrate.

In another embodiment of the method of the present invention the mechanical treatment is performed in a liquid environment by introducing a liquid between the abrasive article and the rigid disk or rigid disk substrate.

In another embodiment of the method of the present invention the abrasive article is oscillated in a direction substantially perpendicular to the direction of travel of the substrate.

The present invention also provides an abrasive article comprising:

- a backing having a first major surface and a second major surface; and
- an abrasive coating consisting essentially of:
  - a hardened binder coating having a first surface adhered to the flexible backing and a second structured surface comprising a plurality of precisely-shaped protrusions; and
  - a diamond-like carbon coating superposed and adhered to at least a portion of the structured surface of the hardened binder coating.

In one embodiment of the abrasive article of the present invention, the diamond-like carbon coating has a thickness ranging from about 5 nm to 1 micrometer. In another embodiment, the diamond-like carbon coating has a plasmon energy greater than about 26 eV.

In another embodiment, the plurality of precisely-shaped protrusions have shapes selected from the group consisting of cubes, prisms, cones, truncated cones, pyramids, and truncated pyramids.

In another embodiment, the parallel elongate ridges each comprise a continuous protrusion of hardened binder extending continuously between the side edges of the backing. In another embodiment, the continuous protrusion is a pyramidal shape having an apex and sides, the sides intersecting at said apex to form an angle therebetween of from about 70 to about 110 degrees. In another embodiment, the ridges each comprise a plurality of separate precisely-shaped protrusions aligned with transverse centers located on said machine direction axis.

In another embodiment, the backing is polyethylene terephthalate film having a thickness between about 25 and 125 micrometers.

In another embodiment, the binder is an acrylate or a methacrylate.

DETAILED DESCRIPTION

The present invention provides abrasive articles suitable for mechanical treatment of rigid disk substrates and also provides a method of mechanically treating rigid disk substrates such as those used for magnetic media disks (e.g., computer disks).

The typical process of mechanically treating a rigid disk substrate using the method of the present invention involves providing a rigid disk substrate that generally has a thickness between 0.75 to 1.25 mm. The substrates can be made from rigid metal or nonmetal materials. The metal materials preferably involve a metal or metal alloy coating applied onto a metal base, where the metal base is preferably an aluminum alloy. The nonmetal materials preferably are glass or ceramic. As can be understood, the "rigid substrate" of the invention is typically in the form of a circular disk constituted by a single distinct layer or plural distinct superposed layers formed into an integral article, which is susceptible to application and adherence of a magnetic layer thereon.

Figure 1:
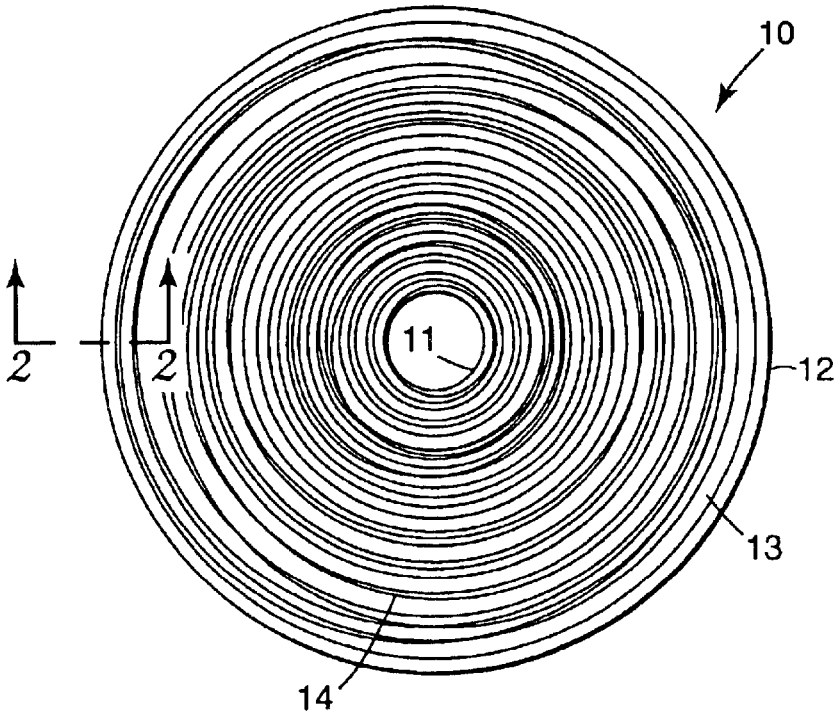
FIG. 1 is a top view of a metal coated rigid disk substrate textured according to the method of the present invention.

Referring to the rigid disk substrate as illustrated in FIG. 1, the rigid disk substrate 10 is generally circular in shape with center hole 11. A metal or metal alloy coating 13 is applied over at least one surface 12 of a disk-shaped metal base 25 (shown in FIG. 2). The metal coating is typically applied to both opposite major surfaces of the rigid disk substrate 10.

For the purposes of the present invention, the coating will be occasionally referred to merely as "metal", but the term will be understood to include metal or metal alloys. The metal is typically applied by electroless nickel plating, although other coating techniques may be employed. The metal coating thickness is generally between 5 to 20 micrometers, and more typically about 15 micrometers.

After coating, the rigid disk substrate surface 12 is polished to a very fine finish, usually by a conventional loose slurry. Loose abrasive slurries comprise a plurality of abrasive particles (typically having an average particle size less than 5 micrometers) dispersed in a liquid medium, such as water or an organic solvent. After polishing with the loose binder precursor, the metal coating has a very fine random scratch pattern or orientation.

After polishing, the metal coating on surface 12 is ready to be mechanically treated (i.e., textured) according to the method of the present invention. In one embodiment, the mechanical treatment of the metal coating on the surface 12 results in a random pattern of scratches 14 in a substantially circumferential direction relative to the center of the rigid disk substrate 10. The scratches are nonconcentric with the center of the rigid disk substrate 10, but preferably substantially circumferential, producing scratches that randomly cross at various points.

Figure 2:
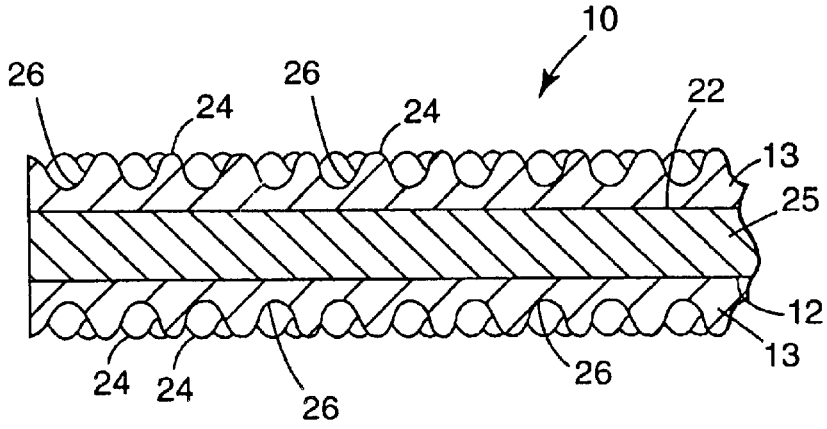
FIG. 2 is a cross-sectional view of a metal coated disk substrate taken along 2—2 of FIG. 1.

Referring now to the partial cross-sectional view of FIG. 2, the rigid disk substrate 10 comprises metal base 25 with a finished metal coating 13 formed on both substrate surfaces 12 and 22, although it will be understood that the coating could be present on only one major surface 12. Scratches 14 are irregular in nature and comprise high regions 24 and low regions 26. The width and height of the scratches 14 do not have to be uniform, although the scratches should not be excessively wide or deep.

The mechanical treatment (i.e., texturing) results in an increase in the exposed surface area of the metal coating(s) 13. The rougher surface may reduce stiction/friction with the computer head and a substantially circumferential scratch pattern may be desired by disk designers since it may enable better differentiation between data tracks.

Although the illustration in FIG. 2 involves a substrate comprised of metal base coated with metal or metal alloy, it is to be understood that the present invention also contemplates mechanically treating substrates made of glass or ceramic material which have no metal or metal alloy thin film coating formed on a surface thereof. It is also believed that the concepts of the present invention may be applicable to plastic substrates. For glass or ceramic substrates, the original surface(s) of the glass or ceramic substrate may be directly subjected to the mechanical treatment method of the present invention. The glass substrate material can be made of a hard amorphous glass material such as a fused mixture of the silicates of the alkali and alkaline-earth or heavy metals. The ceramic substrate material can be constituted by various hard materials made by shaping and then firing a nonmetallic mineral, such as clay, at a high temperature. These ceramic materials include ceramic alloys, such as silicon nitride, silicon carbide, zirconium, and alumina.

Abrasive Article:

The present invention provides an abrasive article having a structured diamond-like carbon (DLC) coating. As used herein, "structured" is used to characterize the topography of the working surface of the abrasive article. A structured topography comprises a plurality of precisely-shaped, three-dimensional protrusions disposed in a predetermined pattern on a backing.

In the present invention, the precisely-shaped, three dimensional protrusions are provided by a hardened binder material coated on a backing material and molded to the desired precise, three-dimensional shape using a production tool. At least a portion of the structured surface of the hardened binder is covered with a hard, diamond-like carbon coating which closely follows the structured surface of the hardened binder. The abrasive coating provides the desired abrasive characteristics without including conventional abrasive minerals in the abrasive coating. In this way, the abrasive coating consists essentially of a hardened binder material having a structured surface and a diamond-like carbon coating superposed over at least a portion of the structured surface of the hardened binder.

The expression "precisely-shaped" (singular and plural forms), as used herein, refers to one or more protrusions having a shape with distinct and discernible boundaries that have been formed by hardening a binder precursor while the binder precursor resides within a cavity of a production tool. Such precisely-shaped protrusions have essentially the same shape as the cavity from which they are formed. A plurality of precisely-shaped protrusions provide a three-dimensional surface topography, where each three-dimensional shape projects outward from the surface of the backing as part of an overall pattern which is the inverse of the pattern of the production tool. These "three-dimensional" shapes include individual protrusions separated from other protrusions in the array at least at their distal ends, and protrusions in the form of ridges which typically are rectilinearly extending ridges. Typically, a thin monolithic layer of the binder material forms a continuous land extending beneath and between the protrusions formed from a production tool.

In this regard, each protrusion is defined by a boundary, the base portion of which being the interface with the backing to which the precisely shape protrusion is adhered. The remaining portion of the boundary is defined by the cavity on the surface of the production tool in which the protrusion was cured.

In one embodiment, the array of protrusions are arranged in a "nonrandom" manner in the sense that the distance between adjacent protrusions is substantially the same throughout the array. Protrusions which are "adjacent" are those having no other protrusion present and intervening along a direct line extending therebetween.

Figure 3:
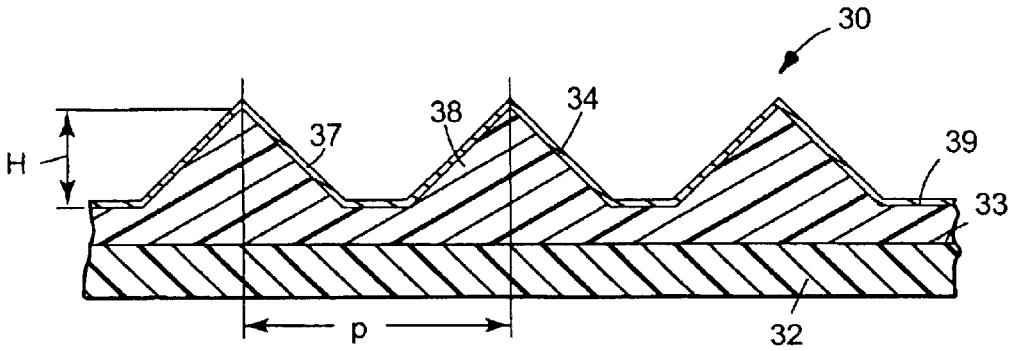
FIG. 3 is a cross-sectional view of one embodiment of an abrasive article of the present invention.

Referring to FIG. 3, structured abrasive article 30 includes a backing 32 having a plurality of precisely-shaped protrusions 34 thereon. Adjacent protrusions are separated from one another at the backing by land area 39. The protrusions 34 are formed of binder material 38 that is formed by hardening a binder precursor. Protrusions 34 are covered with a thin coating of diamond-like carbon coating 37 which follows the shape of the precisely-shaped protrusions to form a structured diamond-like carbon coating. The thickness of the diamond-like carbon coating 37 is typically substantially less than the thickness of the binder material. In FIG. 3, the protrusions 34 are in the form of ridges which are oriented transverse to the lateral width of the abrasive article. A portion of the binder, after being hardened, forms a land portion 39 extending continuously over the upper face 33 of backing 32. In the embodiment of FIG. 3, diamond-like carbon coating 37 covers both the precisely-shaped protrusions 34 and the land portions 39.

Figure 4:
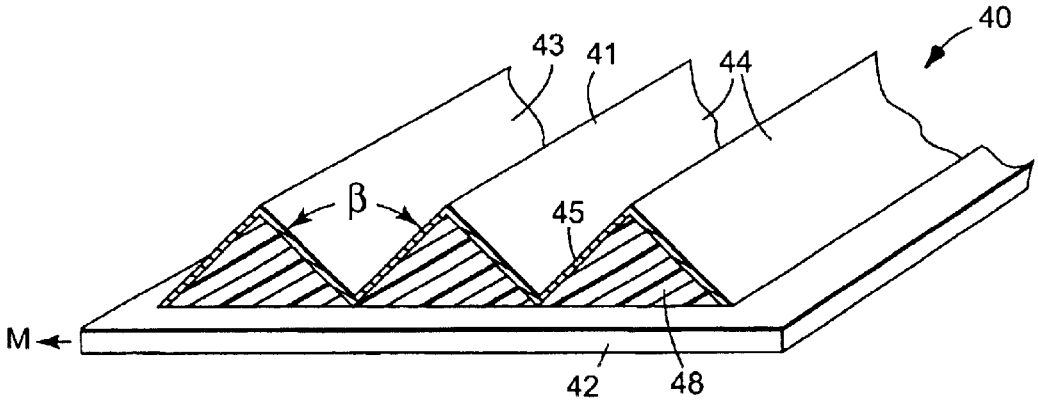
FIG. 4 is a perspective view with the closest end shown in section view of another embodiment of an abrasive article of the present invention.

Referring to FIG. 4, structured abrasive article 40 of the present invention comprises backing 42 having protrusions 44 thereon. The protrusions 44 are formed of binder material 48 that is formed by hardening a binder precursor. The protrusions 44 form elongate continuous ridges having a triangular shape in cross-section and each ridge extends continuously without interruption across the lateral width of the abrasive article. The ridges are oriented at an acute angle of between about 0 to about 90 degrees to the side edges and machine direction M of the abrasive article. The ridges have upper sides 43 and 41 which meet at their lower ends to abut at backing 42 and generally form an angle (p) therebetween of from about 30 to about 10 degrees, as would be observed in a side profile view of the abrasive article. The upper sides 43 and 41 of protrusions 44 are covered with thin coating of diamond-like carbon 45.

In another embodiment of the invention, the abrasive ridges each comprise a continuous line of upraised binder material. In an alternate embodiment of the invention, the abrasive ridges each comprise a plurality of separate precisely-shaped protrusions that are aligned with transverse centers located on said machine direction axis or its imaginary extension line. In a preferred embodiment, the abrasive ridges are comprised of a plurality of individual composites that are intermittently spaced along the aforesaid machine direction line, wherein each of the abrasive composites is precisely shaped and comprises a plurality of abrasive particles dispersed in a binder, which binder provides a means of attachment of the abrasive composites to the aforesaid surface.

Figure 5:
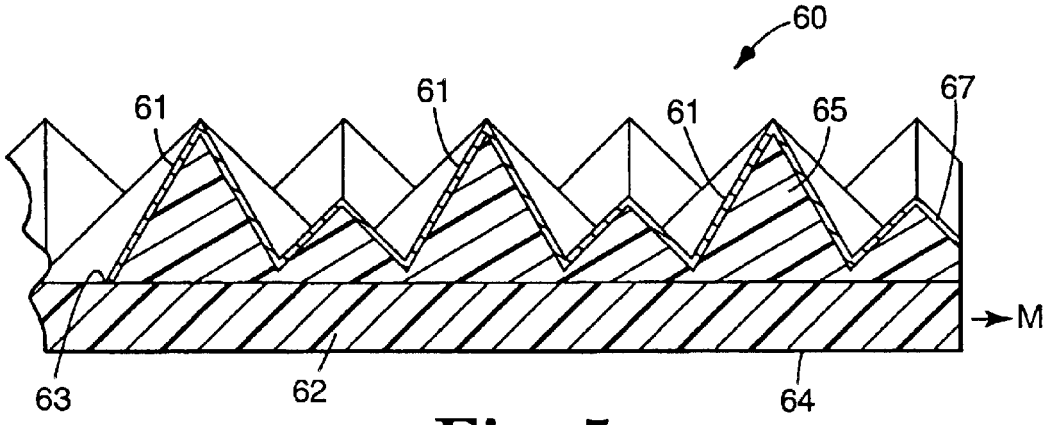
FIG. 5 is a cross sectional view of one embodiment of an abrasive article of the present invention.

FIG. 5 is a cross section view of another embodiment of a structured abrasive article of the present invention. Abrasive article 60 comprises backing 62 with front surface 63 and back surface 64. Front surface 63 of backing 62 bears a plurality of precisely-shaped pyramidal protrusions 61 formed of cured binder material 65. The plurality of precisely-shaped protrusions 61 are arranged on the front surface 63 of backing 62 in a predetermined arrangement of offset rows. A thin diamond-like carbon coating 67 is applied over and is adhered to the precisely-shaped protrusions 61 to form a continuous coating.

Figure 5A:
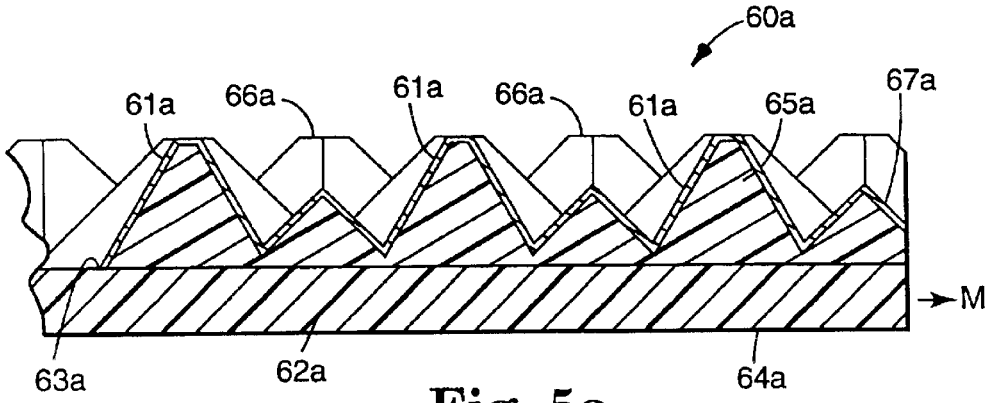
FIG. 5*a* is a cross sectional view of one embodiment of an abrasive article of the present invention.

FIG. 5*a* is a cross section view of another embodiment of a structured abrasive article of the present invention. Abrasive article 60*a* comprises backing 62*a* with front surface 63*a* and back surface 64*a*. Front surface 63*a* of backing 62*a* bears a plurality of precisely-shaped truncated pyramidal protrusions 61*a* having truncated top surfaces 66*a*. The truncated pyramidal protrusions 61*a* are formed of cured binder material 65*a*. The plurality of precisely-shaped truncated pyramidal protrusions 61*a* are arranged on the front surface 63*a* of backing 62*a* in a predetermined arrangement of offset rows. A thin diamond-like carbon coating 67*a* is applied over and is adhered to the precisely-shaped protrusions 61*a* to form a continuous coating.

Backing Materials:

Suitable backing materials have a front and back surface and can be any conventional sheet-like material. Examples of such backings include polymeric film, metallic film, paper, and treated versions thereof, and combinations thereof.

In general, the backing thickness ranges from about 12 to 175 micrometers, more preferably about 25 to 125 micrometers and most preferably from about 25 to 75 micrometers. Preferred backing materials are flat and nonembossed. One preferred backing is a polyethylene terephthalate film (PET) having a thickness from about 25 to 125 micrometers, which preferably is primed, for example, with (poly)ethylene acrylic acid, before applying the binder precursor. One preferred primed PET film is commercially available under the trade designation "454 PET FILM" from Dupont, Hopewell, Va. Another useful backing is a commercially-available primed film available from Teijin America, Inc., Atlanta, Ga., under the trade name "TEJIN SP7". The back side of the backing may contain a coating of a material which improves a slip resistant or frictional engagement with driving devices. An example of such a coating would include a composition comprised of inorganic particulate (e.g., calcium carbonate or quartz) dispersed in an adhesive.

Binder Materials:

The abrasive coating protrusions are formed of a hardened binder material which may be thermoplastic or thermosetting. In the case of thermosetting binders, the binder is typically formed from a flowable binder precursor. During the manufacture of the abrasive article, a thermosetting binder precursor is exposed to an energy source which aids in the initiation of the polymerization and/or curing process. Examples of energy sources include thermal energy and radiation energy, for example, electron beam, ultraviolet light, and visible light. The curing and/or polymerization process converts the binder precursor into a hardened binder.

Alternatively, for a thermoplastic binder, during the manufacture of the abrasive article, the thermoplastic binder is cooled to a degree that results in solidification of the binder precursor.

The binder preferably adheres directly to the front surface of the backing. However, in some instances there may be an additional adhesive layer between the front surface of the backing and the binder.

Examples of thermosetting binder precursors usable in the invention include phenolic resins, urea-formaldehyde resins, melamine formaldehyde resins, acrylated urethanes, acrylated epoxies, ethylenically unsaturated compounds, aminoplast derivatives having $\alpha,\beta$-pendant unsaturated carbonyl compounds, isocyanurate derivatives having at least one pendant acrylate group, isocyanate derivatives having at least one pendant acrylate group, vinyl ethers, epoxy resins, and mixtures and combinations thereof. The term acrylate encompasses acrylates and methacrylates.

One preferred category of thermosetting binder precursors is acrylate resins. Examples of suitable acrylate resins are trimethylol propane triacrylate, triacrylate of tris (hydroxy ethyl)isocyanurate, ethoxylated bisphenol A diacrylate, isobornyl acrylate, phenyoxethyl acrylate, tetra ethylene glycol acrylate and mixtures thereof.

Phenoxyethyl acrylate resin is commercially available from Sartomer Corp. under the trade designation "SR 339"; ethoxylated bisphenol A diacrylate resin is commercially available from Sartomer Corp. under the trade designation "SR 349"; and isobomyl acrylate resin is commercially available from Sartomer Corp. under the trade designation "SR 506". A mixture of these different types of acrylate resins may be preferred to provide an optimal balance of binder properties.

Oligomeric aliphatic urethane acrylates are commercially available from Sartomer Corp. under the trade designations "CN983B88", "CN963B80", CN964E75", CN966J75" and "CN966B85." Oligomeric aromatic urethane acrylates are commercially available from Sartomer Corp. under the trade designations "CN970H75" and "CN973A80."

Optionally, an adhesion promoting agent may also be added to the binder precursor to enhance the adhesion of the hardened binder to the backing material. Suitable adhesion promoting agents are commercially available from Sartomer Corp. under the trade designation "SR9008", "SR901 1", "SR9012", and "CN704." When used, an adhesion promoting agent is typically added to the binder precursor in an amount ranging from about 5–10%-wt. although other amounts may also be found suitable in some applications.

Preferably, the acrylate binder precursors are formulated to provide a cured binder having a glass transition temperature (Tg) ranging from about −40 to 80° C. One preferred blend of urethane acrylate binder precursors includes about 10–75%-wt CN983B88 and about 80–20%-wt CN966B85. More preferably, the blend includes about 10–35%-wt CN983B88 and about 80–55%-wt CN966B85. Another preferred blend of urethane acrylate binder precursors includes about 10–75%-wt CN963B80 and about 80–20%-wt CN966B85. More preferably, the blend includes about 10–50%-wt CN963B80 and about 80–45%-wt CN966B85. Yet another preferred blend of urethane acrylate binder resins includes about 10–75%-wt CN964E75 and about 80–20%-wt CN966B85. More preferably the blend includes about 10–50%-wt CN964E75 and about 8045%-wt CN966B85. Still another preferred blend of urethane acrylate binder resins includes about 20–79%-wt CN970H75 and about 70–20%-wt CN973A80. More preferably the blend includes about 20–70%-wt CN970H75 and about 70–20%-wt CN973A80.

A release agent may also be added to the binder precursor to improve release of the hardened binder from the production tool. One suitable release agent is a fluorochemical commercially available under the trade designation "FC-430" from Minnesota Mining and Manufacturing Corp, St. Paul, Minn.

Curing Agent:

Depending upon the energy source that is utilized and the binder precursor chemistry, a curing agent, photoinitiator, or catalyst is sometimes preferred to help initiate polymerization of the binder precursor. For instance, examples of suitable photoinitiators that generate a free radical source when exposed to visible radiation, are described in U.S. Pat. No. 4,735,632 (Oxman et al.). The preferred initiator for use with visible light is commercially available from Ciba Geigy Corp. under the trade designation "IRGACURE 369" or "CIBA 1173." The photoinitiator is typically used in an amount of between about 0.5 to 5%-wt., more preferably 0.5 to 1%-wt., based on total weight of the binder precursor. On the other hand, if the energy source is electron-beam ("E-beam"), free radicals to initiate polymerization in the binder are generated and provided by the energy source itself.

Protrusion Shape and Arrangement:

The layer of binder having a structured surface may be formed as a plurality of rectilinear ridges, each ridge being formed of a continuous line extending between the side edges of the backing, or alternatively, each ridge may be formed of a plurality of individual protrusions intermittently located along an imaginary line extending between the side edges of the backing. These rectilinear ridges are positioned as parallel rows on the backing. The parallel rows may meet a side edge of the backing at an angle ranging from 0 to 90 degrees.

In the embodiment involving protrusions that are shaped as continuous rectilinear ridges, the ridges are formed by appropriately shaping a binder precursor with a production tool, described hereinbelow, which is configured to present the converse shape of the desired pattern of ridges. The mold or production tool is removed after the binder precursor is sufficiently hardened to hold the basic precisely-shaped topography imparted into the binder precursor by the cavities of the production tool. The binder precursor used to form the continuous ridges can be slightly overfilled into the production tooling to the extent that land portions are formed between the adjacent ridges at their lower portions, viz. up to about 25% of the height of the ridges, by virtue of a continuous layer of binder extending underneath and between the three-dimensional ridges extending from the horizontal outer surface of the lands.

In an alternate embodiment involving ridges comprised of individual protrusions formed intermittently along rows tracing rectilinear lines, each individual abrasive protrusion has its own shape associated with it. The individual shape has a surface or boundaries associated with it that results in one protrusion being separated to some degree from another adjacent protrusion. That is to say, to form an individual protrusion, a portion of the planes or boundaries forming the shape of the protrusion must be separated from one another. This separation portion must include at least the upper portion or distal ends of the protrusions. The lower or bottom portion of the protrusions may abut one another, or, alternatively, the protrusions may be spaced apart to expose the land portions. If the individual protrusions are spaced-apart, then typically, the binder precursor used to form same is slightly overfilled into the production tooling, described in more detail hereinafter, to the extent that a land portion of abrasive material is formed extending as a continuous layer underneath and between the protrusions at their lower portions. The land portion thickness typically equals about 25% of the height of distension of the protrusions from the land portions. In any event, individual protrusions may be formed, for example, by the various methods reported in U.S. Pat. No. 5,152,917 (Pieperet et al.)

The individual protrusions typically are equidistantly spaced apart along the common ridge. If distinct or individual protrusions are used to make up each of the ridges, the protrusion shapes preferably should be selected to be a regular geometric shape such as cubic, prismatic, conical, truncated conical, pyramidal, truncated pyramidal, composite shaped such as a truncated conical base with dome-shaped tip, and the like. Grooves or open spaces left between the ridges will extend linearly at an angle tracking the angle of extension of the adjoining ridges. Also, the height of the protrusions is preferred to be constant across the entire area of the abrasive article. These shapes are precise as they closely correspond to the cavity shape in the production tool used to shape the binder precursor.

The number of individual protrusions can be anywhere from 5 to 15,000 protrusions per square centimeter, or even more, but most preferably from about 1,000 to 10,000 protrusions per square centimeter. For the embodiment providing ridges made up of intermittent individual protrusions aligned in rows, the spacing between adjacent protrusions is selected to be a value which is constant in all ridges, and generally is in a range of 5 to 200 micrometers.

For all embodiments having ridges, the ridges are at least separated at their distal ends, although they may be abutted or separated at their attachment ends to the backing. It is possible that adjacent protrusions may be completely separated near both the distal end and the attachment end such that the backing is exposed in-between ridges.

The spacing or pitch between the ridges, whether the continuous or intermittent variety, as measured from one mid-point of one ridge to that of the adjacent or nearest ridge, indicated as "p" in FIG. 3, is selected to be a uniform value through any particular array. For purposes of this invention, an adjacent ridge means a ridge which faces a subject ridge over a common groove without any intervening ridges located therebetween. The pitch "p" generally is set as a value between about 3 and about 500 micrometers, more preferably between about 1 and 50 micrometers, and most preferably between about 1 and 25 micrometers.

For purposes of this invention, the height H for either the continuous ridge embodiment (such as shown in FIG. 3) or the use of individual protrusions arrayed in rows of ridges is measured as the vertical distance between either the outer surface of the backing or any land surface on the protrusion side of the abrasive article to the outermost extent of the distal end of the protrusion, and generally is a value in the range from about 10 to 1000 micrometers, more preferably about 10 to 100 micrometers, and most preferably about 1 to 15 micrometers.

However, while certain range values have been described above in connection with using the abrasive composite ridges to mechanically treat rigid memory disks, it is to be understood the method of the invention may be applicable to many other applications and the optimal pattern size and angle may vary and may be empirically determined for each application.

Method for Making a Substrate Having a Structured Polvmer Surface:

In order to make an abrasive article of the present invention a substrate having a structured polymer surface must first be prepared. A preferred method for making a backing having a structured polymer surface comprises the steps of:

(a) providing a production tool having a major surface said major surface having a plurality of precisely shaped recesses formed therein;

(b) filling the precisely shaped recesses with a binder precursor;

(c) providing a backing having a front and a back surface;

(d) laminating the front surface of a backing to the surface of the production tool so that at least a portion of the front surface of the backing is in contact with the binder precursor;

(e) subjecting the binder precursor to conditions sufficient to at least partially cure the binder precursor; and (f) separating the backing from the production tool.

The production tool contains a plurality of cavities, which are essentially the inverse shape of the protrusions and are responsible for generating the shape of the protrusions. There should be preferably 5 to 15,000 cavities per square centimeter. It is preferred to have between 5 and 10,000 ridge-forming cavities spaced in parallel per square centimeter. These cavities make it possible to form an abrasive article having a corresponding number of protrusions/square centimeter. These cavities can have any of a variety of geometric shapes as cubic, prismatic, pyramidal, truncated pyramidal, conical, and the like to form individual protrusions. Alternatively, the cavities can be linear continuous groove-shapes to form continuous ridges, such as where individual grooves have a triangular profile and the an overall contour of the surface of the production tool is a saw-tooth contour. The dimensions of the cavities are selected to achieve the desired number of protrusions/square centimeter.

The production tool can be a belt, a sheet, a continuous sheet or web, a coating roll such as a rotogravure roll, or a sleeve mounted on a coating roll. The production tool can be composed of metal (e.g., nickel), metal alloy, ceramic, or plastic. A metal production tool can be fabricated by any conventional technique such as engraving, hobbing, etching, electroforming, diamond turning, etc. A thermoplastic tool can be replicated off a metal master tool. The master tool will have the inverse pattern desired for the production tool. The master tool is preferably made out of metal, e.g., chrome-plated nickel. The thermoplastic sheet material can be heated and optionally along with the master tool such that the thermoplastic material is embossed with the master tool pattern by pressing the two together. The thermoplastic can also be extruded or cast onto to the master tool and then pressed, after which, the thermoplastic material is cooled to solidify and produce a production tool.

The production tool may also contain a release coating to permit easier release of the abrasive article from the production tool. Examples of such release coatings include silicones and fluorochemicals. If a plastic production tool is used, it is preferred that the polymer used is grafted with the silicone or fluorochemical.

Preferred methods for the production of production tools are reported in U.S. Pat. Nos. 5,435,816 (Spurgeon et al.), 5,658,184 (Hoopman et al.), and in U.S. Ser. No. 08/923,862 (Hoopman), filed Sep. 3, 1997.

When the binder precursor comprises a thermosetting binder precursor, the binder precursor is hardened via a polymerization process. Polymerization is typically initiated by exposure to an energy source. Examples of energy sources include thermal energy and radiation energy. The amount of energy depends upon several factors such as the binder precursor chemistry, the dimensions (e.g., thickness) of the binder precursor, and the amount and type of the optional additives. For thermal energy, the temperature can range from about 30 to 150° C., generally between 40 to 120° C. The time can range from about 5 minutes to over 24 hours. The radiation energy sources include electron beam, ultraviolet light, or visible light. Electron beam radiation, which is also known as ionizing radiation, can be used at an energy level of about 0.1 to about 10 Mrad, preferably at an energy level of about 1 to about 10 Mrad. Ultraviolet radiation refers to radiation having a wavelength within the range of about 200 to about 400 nm, preferably within the range of about 250 to 400 nm. It is preferred that 300 to 600 Watt/inch (120 to 240 watt/cm) ultraviolet lights are used. Visible radiation refers to non-particulate radiation having a wavelength within the range of about 400 to about 800 nanometers, preferably in the range of about 400 to about 550 nm, and is preferably used at an energy level of 300 to 600 watt/inch (120 to 240 watt/cm).

In one aspect, a binder precursor is first coated directly onto the front surface of a backing using any conventional coating technique such as, for example, roll coating, transfer coating, spraying, die coating, vacuum die coating, knife coating, curtain coating, and rotogravure coating. The production tool is then brought into contact with the binder precursor coated backing such that the binder precursor flows into the recesses of the production tool. Pressure may be applied by a nip roll or other suitable technique in order to force the binder precursor to flow in and fill the recesses of the production tool.

In a preferred aspect of this method, the recesses are filled by coating the binder precursor directly onto the production tool. This can be accomplished by any conventional coating method such as, for example, roll coating, transfer coating, spraying, die coating, vacuum die coating, knife coating, curtain coating, or rotogravure coating. The backing is then brought into contact with the outer surface of the production tool such that the binder precursor wets the surface of the backing. Pressure may be applied by a nip roll or other suitable technique in order to force the binder precursor against the backing to improve adhesion between the resulting binder and the backing.

Next, the binder precursor is hardened. This can be accomplished by exposing the binder precursor to energy from an energy source. The energy may be heat, radiation energy (i.e., infrared or visible radiation), or electron beam. Preferably the energy is radiation energy. The radiation energy can be transmitted through the backing or through the production tool. Preferably, the backing and production tool do not appreciably absorb the radiation energy. Additionally, the radiation energy source should not appreciably degrade the backing or production tool. Alternatively, if the production tool is made from certain thermoplastic materials (e.g., polyethylene, polypropylene, polyester, polycarbonate, poly (ether sulfone), poly(methyl methacrylate), polyurethanes, polyvinylchloride, or combinations thereof) ultraviolet or visible light can be transmitted through the production tool and into the binder precursor. Following hardening of the binder precursor (i.e., formation of a binder), the backing having the structured binder bonded thereto is separated from the production tool.

The resulting hardened binder material will have a structured surface corresponding to the inverse pattern of the production tool. By at least partially hardening the binder precursor on the production tool, the binder will retain its precisely-shaped structured topography after removal from the production tool. The binder precursor may be further hardened, for example, by heat treatment after removal from the production tool. Heat treatment may be beneficial to more completely remove volatile components from the binder which may impede pump-down during the subsequent vacuum deposition of the diamond-like carbon coating.

Diamond-Like Carbon Coating:

After formation of a substrate having a structured polymer surface, a diamond-like carbon coating is then applied over at least a portion of the structured surface to provide an abrasive article of the present invention. The diamond-like carbon film is also occasionally referred to herein in the abbreviated form of "DLC." As used herein, DLC is meant to encompass sputter-deposited carbon coatings, hydrogenated DLC coatings, and nonhydrogenated DLC coatings. Sputter deposited carbon coatings are deposited as neutral carbon atoms and may be characterized in that the coating contains mostly graphite-like sp2 bonds. Hydrogenated DLC coatings are produced from a gaseous hydrocarbon plasma. Several techniques may be used to produce such hydrogenated DLC coatings including, for example RF plasma CVD, in which the depositing species is mainly activated hydrocarbon molecules and molecular fragments. Typically hydrogenated DLC coatings include between 10–60 atomic percent hydrogen. Non-hydrogenated DLC, also referred to as tetrahedrally coordinated, non-crystalline, carbon may be deposited by either pulsed laser deposition or cathodic arc. In these two processes, the deposition species are energetic carbon ions which impact the substrate to be coated with sufficient energy to at least partially imbed in the substrate.

The plasmon energy of hydrogenated DLC coatings is less than about 25 eV whereas the plasmon energy for non-hydrogenated DLC coatings is about 26 eV or greater, typically between 27 to 30 eV. The plasmon energy of the DLC film is determined by using Electron Energy Loss Spectroscopy (EELS). The plasmon energy is related to the structural properties of the DLC film because it is proportional to the valence electron density which is proportional to the atom density. Plasmon energy of DLC films may be measured in the reflective mode with a beam energy of about 2000 eV wherein the DLC film does not have to be separated from the substrate.

The average thickness of the hard carbon coating layer or film of diamond-like carbon material in the invention is usually less than 50 micrometers, preferably less than 10 micrometers, more preferably less than 1 micrometer, and most preferably in the range of 100 to 2000 Angstroms. A DLC film thickness above 5000 Angstroms may not be desirable in all cases as it becomes relatively expensive to manufacture, and if it has high hardness, may become brittle and loose adhesion. On the other hand, a DLC thickness below 100 Angstroms may not be desirable in all cases as not being thick enough to be used in mechanical treatments of rigid disk surfaces.

The coating period to attain the desired thickness can range from about 10 seconds to about 10 hours, usually between about 30 seconds and about 10 minutes when using cathodic arc plasma deposition. The coating time is determined by the length of material that must be coated to the target DLC coating thickness. The chamber atmosphere, carbon source, and power can be controlled to adjust the coating time in ways understood by those of skill in the cathodic arc coating field.

Other methods of producing the diamond-like carbon films, whether hydrogenated or non-hydrogenated varieties, include generally known techniques such as chemical vapor deposition (CVD), plasma assisted CVD, ion beam, laser ablation, RF plasma, microwave, arc discharge and cathodic arc plasma deposition. In one embodiment, a cathodic arc coater is used to deposit the diamond-like carbon films. The cathodic arc coater is of a horizontal configuration arranged with approximately 90 centimeters distance provided between the cathode and the article to be coated. However, distances ranging from 5 to 500 cm are feasible between the cathode and the article to be coated as long as appropriate measures, described herein, are taken to sufficiently restrain the temperature build-up of the abrasive article to prevent graphitization of the diamond-like carbon film formed. The relatively large separation between the arc source and the sample article allows the diamond-like carbon coating to be deposited at temperatures conducive for DLC formation and yet at lower temperatures than those usually experienced and employed for diamond coating. The distance allows an optional macroparticle filter to be employed, such as described in U.S. application Ser. No. 08/149,292, filed Nov. 11, 1993, the disclosure of which is incorporated herein by reference. It is also within the scope of this invention to only coat a region or portion of the structured backing material. For example, only the outer few centimeters could be coated.

In order to produce diamond-like carbon films, the cathodic arc coater is provided with a carbon source as the cathode material. Various materials usable as the cathode material include, pyrolytic graphite, amorphous carbon, graphite, and vitreous carbon. The coating procedure is usually performed in a vacuum, usually less than $10^{-4}$ torr. The residual gas can be either air (i.e., mainly nitrogen and oxygen) or an inert gas.

Optionally, the substrate may be pretreated by cleaning and scrubbing away of contaminants which might interfere with the adhesion of the DLC coating film deposited thereon. Cleaning of the substrate before or during DLC coating may be accomplished with an inert plasma or an ion beam, such as an ion beam comprised of ions derived from argon, helium, krypton, xenon, or a member of Group 8 of the Periodic Table. Argon is preferred as the scrubbing plasma due to its cost and availability.

The hard carbon coating layer of DLC material is applied to the precisely-shaped, three-dimensional surface of the substrate in such a way as to not substantially degrade, destroy or deteriorate the substrate or its precise shape. That is, during application of the DLC layer, care must be taken not to destroy or adversely affect the substrate due to exposure to excessive heat. Therefore, care must be taken not to generate excessive heat during the application the DLC layer. Further, excessive heat may cause undesired graphitization of the DLC material. As a general requirement, the temperature of the abrasive article should be maintained below about 200° C. at all times during the formation of the DLC film so as to prevent damage to the substrate and to prevent graphitizaton of the DLC film itself.

One preferred method of applying a DLC coating to a moving web is referred to as pulsed cathodic arc plasma deposition and is reported in U.S. Pat. No. 5,643,343 (Selifanov et al.). In pulsed cathodic arc plasma deposition the cathodic arc plasma discharge is powered by electrical energy that is stored in a bank of capacitors. The time-varying nature of a capacitor discharge produces time-varying fields that act to self-focus the plasma. For this reason, an external magnetic field transport system is unnecessary with this technique as with DC powered cathodic arc processes. The short time associated with the capacitor discharge, typically less than 500 microseconds, limits the distance over which the arc-spot can move which coupled with the higher instantaneous currents combine to produce a more stable and reproducible discharge. All of these factors combine to produce a process that allows thickness to be more accurately controlled as the thickness is directly related to the number of capacitor powered plasma discharges (i.e., thickness is controlled by counting the number of pulses of the capacitors). This process enables uniform deposition on a moving web because the intervening magnetic field is not needed and control of the pulse frequency controls uniformity of the DLC coating thickness. In addition to providing a more uniform film thickness, another benefit of pulsed cathodic arc plasma deposition is that the production of macroparticles is significantly reduced when using this technique compared to conventional DC powered cathodic arc methodologies, thereby allowing cleaner coatings to be produced.

Figure 6:
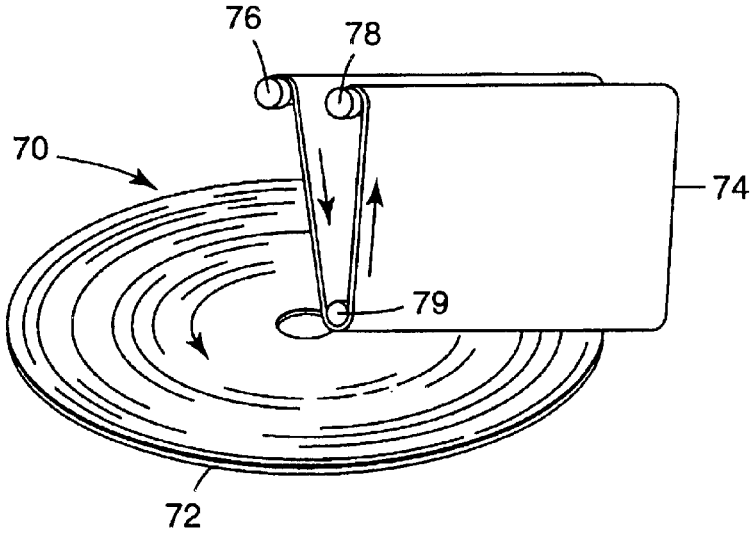
FIG. 6 is a schematic of a texturing apparatus for use with the method of the present invention.

Apparatus for Mechanical Treatment:

FIG. 6 is a schematic representing a mechanical treatment apparatus 70 for use in the method of the present invention. Although the mechanical treatment of only one side of the substrate 72 is depicted, it is understood that both sides of the substrate 72 can be typically treated simultaneously by separate abrasive articles or by the same abrasive article. The mechanical treatment is preferably done wet or under a water flood in the presence of a surfactant. Substrate 72 is generally between 50 to 200 millimeters in diameter, usually between 60 to 150 mm. The substrate 72 is installed on a machine such as a model 800C HDF Rigid Disk Burnisher from the Exclusive Design Company (EDC), Fox Lane, Calif. The machine spins the substrate 72 between about 50 to 700 rpm, resulting in a surface speed on the disk of between about 7.5 to about 440 meters/minute, although faster or slower speeds also are contemplated. The abrasive article 74 of the present invention is preferably provided in a continuous roll form having a width between 20 to 60 millimeters, preferably between 25 to 50 mm. The continuous roll of the abrasive article 74 is unwound from one station 76 to a second station 78. In between, the abrasive article 74 contacts the surface of the substrate 72 with the aid of a roller 79 as the substrate 72 rotates. Roller 79 has a preferred diameter of about 50 mm and is preferably constructed of an elastomeric material having a Shore A hardness value of about 50. The force between the abrasive article 74 and the substrate 72 is between 0.1 to 4 kg, preferably between 0.5 and 3 kg, for a contact length of 31.1 mm using a rubber roll having a diameter of 50 mm and a Shore A hardness value of 45 to 60, preferably 50. If the pressure is too high, the resulting surface finish, Ra, will be too high, i.e., greater than about 7 nanometers (0.0070 micrometers). If the pressure is too low, then the scratch height will be low and the surface finish will be too low, i.e., less than about 1.8 nanometers (0.0018 micrometers). The preferred method includes oscillating roller 79 in a radial direction relative to the substrate 72 during the texturing process. The radial oscillation ensures that the scratches formed by the abrasive article 74 are not concentric on the substrate 72, but are, instead, substantially circumferential with random crossings. During mechanical treatment, the abrasive article 74 is also moved at a controlled rate between stations 76 and 78 to provide a known and uniform treatment to substrate 72 and to continuously replace the abrasive contacting the disk with clean abrasive. The indexing speed of the abrasive article 74 is between 5 to 400 cm/minute, preferably between 15 to 250 cm/min. The combination of the indexing abrasive article 74 and the oscillating roller 79 provides the random, substantially circumferentially spaced scratches desired. The rigid substrate 72 is typically cleaned to remove any debris or swarf after texturing. After cleaning, any conventional magnetic coating can be applied over the scratches. In a typical rigid magnetic media disk, a coating, such as chrome, is applied over a textured surface of the substrate. An additional coating of a magnetic material is applied over the chrome coating, for example, a CoXY alloy, where Co is cobalt, X can be platinum or tantalum, and Y can be chrome or nickel. Finally a carbon coating is applied over the magnetic coating.

The following definitions are used when evaluating texturing of substrates of the current invention:

- Ra: is the arithmetic average deviation of the absolute values of the roughness profile from the mean line or center line. The center line divides profiles such that all areas above it are equal to all areas below it.
- Rms: is the root mean square or geometric average deviation of the roughness profile from the mean line measured in the sampling length.
- P-V: peak/valley (also known as Rt) is the vertical distance between the highest peak and the lowest valley in the sampling length leveled on the mean line.
- Rp: is the distance between the mean line and the highest peak within the sampling length.
- Rv: is the distance between the mean line and the lowest valley within the sampling length.

The following non-limiting examples will further illustrate the invention. All parts, percentages, ratios, and the like, in the examples are by weight unless otherwise indicated. The following abbreviations are used throughout:

EXAMPLES

Materials List:

UACRI: aliphatic urethane acrylate monomer commercially available from Henkel Corp. under the trade designation "PHOTOMER 6010."

TMPTA: trimethylolpropane triacrylate monomer commercially available from Sartomer Corp. under the trade designation "SR-351".

PI1: free radical photoinitiator commercially available from Ciba Specialty Chemicals Additives under the trade designation "DAROCURE 1173."

General Procedure 1: Method of Making a Structured Substrate:

First, a binder precursor was prepared by thoroughly mixing the materials indicated in the Example. All of the ratios are based upon weight. The binder precursor was coated onto a metal production tool having the topography denoted in the Example, such that the binder precursor filled recesses in the tool. Next, a polyester film (3M Heatsealable Polyester #29972) substrate was pressed against the production tool by means of a nip roller and the binder precursor was allowed to wet the front surface of the polyester film which had a primer thereon. Ultraviolet light, about 600 watts/in (236 watts/cm) was transmitted through the backing and into the binder precursor. The ultraviolet light initiated the polymerization of the binder precursor. This exposure to ultraviolet light resulted in the binder precursor being transformed into a hardened binder which was adhered to the polyester film backing. Next, the polyester film with the hardened structured binder coating was separated from the production tool.

General Procedure 2: Diamond-Like Carbon Coating:

The following general procedure describes the method for forming a diamond-like carbon coating. Each of the Examples was coated with DLC by mounting a roll of structured substrate material into a vacuum system with a single carbon pulsed cathodic arc system similar to that described by U.S. Pat. No. 5,643,343. The carbon feedstock cathode was obtained from Poco Graphite Inc., material grade SFG-2. In this procedure, however, the carbon plasma source was mounted such that the carbon plasma was directed vertically upwards. The substrate was mounted such that the structured surface of the substrate was facing downwards and in the line-of-sight to the carbon plasma source. The structured surface of the substrate was positioned about 15 inches (38.1 cm) from the carbon cathode in the cathodic arc plasma source. After mounting the polymer rolls, the system was evacuated to a pressure less than about $1\times10^{-5}$ Torr. The carbon pulsed cathodic arc plasma source was operated to provide about 0.33 to 0.5 A per pulse. The parameters were as follows: Main Voltage: 300 V; Auxiliary Voltage: 300 V; Ignition Voltage: 700 V; and Setpoint Frequency: 3.3 Hz. The structured substrate was moved past the carbon plasma deposition zone at a speed of 1 ft/min, the desired thickness of the DLC coating was built up by moving the web across the deposition zone in multiple passes.

After applying the DLC coating the resulting structured DLC coated abrasive material was removed from the vacuum system and was ultrasonically cleaned to remove any particulate contamination that may have attached to the material during its transport through the vacuum system. The ultrasonic cleaning head, the Ultra Cleaner, was purchased from Web Systems Inc. After ultrasonic cleaning, the structured DLC coated abrasive material was slit to a width of 1.375" (3.5 cm) using a knife slitting system.

Texturing Procedure 1:

The texturing test was performed on a rigid disk using the method of the present invention. A model 800C HDF Rigid Disk Bumisher, manufactured by Exclusive Design Co., San Jose, Calif., was used. The rigid disk substrate was a (95 mm diameter) nickel/phosphorus (NIP) plated aluminum disk, polished Falcon substrate, 335326 obtained from Akashic Memories Corp., San Jose, Calif.

Two 1-⅜" wide spools of abrasive were mounted into the EDC 800C disk burnisher such that one tape was in contact with 1 side of the disk while the other tape was in contact with the other side of the disk. The abrasive article was positioned such that the width of the tape is contacting the full radius of the disk. The disk was rotated at 150 rpm. Cleaning tapes, standard practice in industry, were also used in the test and are positioned diametrically opposite the finishing tape so that the disk surface passes under both the abrasive and the cleaning tape for each disk revolution. The abrasive article was advanced at 9.4 in/min so that fresh, abrasive was continuously brought into contact with the disk surface. The abrasive article was pressed into the rigid disk surface by an elastomer roller, with Shore durometer A50, with a load roll force of 4.36 lbs. The texture time for each disk was 35 seconds.

Texturing Procedure 2:

The texturing test was performed on a rigid disk using the method of the present invention. A model 1800 HDF Rigid Disk Burnisher, manufactured by Exclusive Design Co., San Mateo, Calif., was used. The rigid disk substrates were nickel/phosphorus (NIP) plated aluminum disks having a diameter of 95 mm, a thickness of 31.5 mm, and an 8–13 Ra surface. The disk substrates were commercially available as part number 15-003-01 from StorMedia Inc., Santa Clara, Calif.

Two 1-⅜" wide spools of abrasive were mounted into the disk burnisher such that one tape was in contact with 1 side of the disk while the other tape was in contact with the other side of the disk. The abrasive article was positioned such that the width of the tape is contacting the full radius of the disk. The disk was rotated at 80 rpm. Cleaning tapes were also used in the test and were positioned diametrically opposite the finishing tape so that the disk surface passes under both the abrasive and the cleaning tape for each disk revolution. A coolant was dripped at a rate of 12 nil/min onto the cleaning tape. The coolant consisted of a 1% solution of Development X2, 590–27, commercially available from Coral International Inc., Paramount, Calif. The abrasive article was advanced at 3.0 in/min under a tension of 1.0 lb. so that unused abrasive was continuously brought into contact with the surface of the disk. An oscillation amplitude of 0.05 inches with an oscillation frequency of 7.6 Hz was used during the texturing process. The abrasive article was pressed into the rigid disk surface by an elastomer roller having a Shore durometer A50, with a load roll force of 2.5 lbs. The texture time for each disk was 30 seconds.

Test Procedure 1: Surface Profilometer Measurements on Textured Disks:

The surface of the textured rigid disk was then characterized with contact stylus profilometer to determine how the mechanical treatment with the subject invention had altered the disk's surface topography. A Model "P2" Tencor profilometer with a 0.15 micron stylus using a 0.2 mm trace with 5 mg force was used for these "roughness" measurements. Typically, several roughness parameters are recorded, including: Ra, Rq, Rp, Rv, Rt, Rz, PC(10 Å), PC(40 Å), and PC(70 Å). The last 3 parameters are related to the number of peaks in a certain size range that can be found over the scan distance. 12 measurements were taken, 6 on each of 2 disk sides.

Example 1

A structured substrate was prepared according to General Procedure 1. The structured surface comprised truncated 4-sided pyramids spaced at 600 lines per inch. The production tool was obtained from Southern Flexographic Coatings, Louisville, Ky. and was designated as "Q-34". The binder precursor formula comprised 49.5 parts by weight UACR-1, 49.5 parts by weight TMPTA and 1 part by weight P11.

After forming the structured substrate, a diamond-like carbon coating was applied to the structured surface of the substrate according to General Procedure 2. The number of passes across the deposition zone is noted in Table 1. The resulting abrasive articles were used to texture disks according to Texturing Procedure 1 and the resulting textured disks were characterized using Testing Procedure 1. The results are reported in Table 1.

Example 2

A structured substrate was prepared according to General Procedure 1. The structured surface comprised continuous ridges having a triangular cross section. The included (i.e., peak) angle of the ridges was 90 degrees and the ridges were spaced on the backing at a peak-to-peak distance of 24 micrometers. The continuous ridges were oriented parallel to the side edges of the backing (i.e., the ridges were continuous in the downweb direction). After forming the structured substrate, a diamond-like carbon coating was applied to the structured surface of the substrate according to General Procedure 2. The number of passes across the deposition zone is noted in Table 1. The resulting abrasive articles were used to texture disks according to Texturing Procedure 1 and the resulting textured disks were characterized using Testing Procedure 1. The results are reported in Table 1.

TABLE 1

| Avg (A + B) | Ra | Rq | Rp | Rv | Rt | Rz | PC (10Å) | PC (40Å) | PC (70Å) |
|---|---|---|---|---|---|---|---|---|---|
| Control disk | 16 | 20.3 | 84.3 | −77.8 | 176.0 | 135.2 | 380 | 56.3 | 5.5 |
| Control disk | 17.6 | 22.7 | 98.5 | −94.3 | 193 | 148.7 | 490.4 | 84.8 | 7.6 |
| Example 1 5 passes | 19.5 | 25.5 | 131 | −141 | 272.3 | 189.5 | 556 | 118.9 | 17.6 |
| Example 1 9 passes | 19.9 | 29.4 | 236.5 | −92. | 328.5 | 217.8 | 544 | 125.3 | 36.2 |
| Example 2 5 passes | 18.7 | 25.4 | 163.8 | −91.2 | 255 | 192.2 | 455 | 122.9 | 41.3 |
| Example 2 9 passes | 27.1 | 38.2 | 262.6 | −142.5 | 405.4 | 298.9 | 548 | 210.5 | 97.5 |

The results show that the abrasive articles of the present invention removed material from the disk surface and added a line density pattern to the disk surface, as inferred from the increased peak count (PC) values and photomicrographs. In addition, the thicker DLC coating was more aggressive and increased the disk's roughness parameters, such as Ra, more than for the thinner coating. In addition, the two patterns modified the surface topography differently, the abrasive article of Example 4, having a linear pattern, had a greater increase on the PC (Peak Count) values, while the Ra values only slightly increased.

Example 3

A structured substrate was prepared according to General Procedure 1. The structured surface comprised truncated 4-sided pyramids spaced at 600 lines per inch. The production tool was obtained from Southern Flexographic Coatings, Louisville, Ky. and was designated as "Q-34". The binder precursor formula comprised 49.5 parts by weight UACR-1, 49.5 parts by weight TMPTA and 1 part by weight PI1.

After forming the structured substrate, a diamond-like carbon coating was applied to the structured surface of the substrate according to General Procedure 2. The number of passes across the deposition zone is noted in Table 1. The resulting abrasive articles were used to texture disks according to Texturing Procedure 2 and the resulting textured disks were characterized using Testing Procedure 1. The results are reported in Table 2.

Example 4

A structured substrate was prepared according to General Procedure 1. The structured surface comprised continuous ridges having a triangular cross section. The included (i.e., peak) angle of the ridges was 90 degrees and the ridges were spaced on the backing at a peak-to-peak distance of 24 micrometers. The continuous ridges were oriented parallel to the side edges of the backing (i.e., the ridges were continuous in the downweb direction).

After forming the structured substrate, a diamond-like carbon coating was applied to the structured surface of the substrate according to General Procedure 2. The number of passes across the deposition zone is noted in Table 2. The resulting abrasive articles were used to texture disks according to Texturing Procedure 2 and the resulting textured disks were characterized using Testing Procedure 1. The results are reported in Table 2.

TABLE 2

| | Ra | Rp | Rv |
|---|---|---|---|
| Example 3 | 11.8 | 47.0 | 72.0 |
| Example 4 (BEF) 5 passes | 15.1 | 97.0 | 120.6 |
| Example 4 (BEF) 9 passes | 28.2 | 121.3 | 288.0 |
| Control Disk | 11.9 | 35.0 | 42.0 |

The above examples demonstrate that an abrasive article of the present invention may be used to alter the surface topography of a rigid disk or rigid disk substrate. It is well established that workpiece surface characteristics (e.g., topography, roughness, etc.) are correleated with the surface topography of the abrasive article. Furthermore, it is known that an abrasive article's cut rate is related to the amount of hard material and its hardness. Therefore, the present invention demonstrates that an abrasive article could be made that is optimized to mechanically treat a rigid disk or rigid disk substrate in a controlled way. This invention provides an abrasive article with a precise surface topography that will impart a desired surface topography on a rigid disk or rigid disk substrate. Advantageously, the abrasive article aggressiveness (i.e., cut rate) can be controlled by controlling the diamond-like coating thickness thereby providing improved control of mechanical treatment processes such as texturing, buffing, and cleaning over conventional grit-based abrasive article.

Various modifications and alterations of this invention will become apparent to those skilled in the art without departing from the scope and spirit of this invention, and it should be understood that this invention is not to be unduly limited to the illustrative embodiments set forth herein.

What is claimed is:

1. A method of mechanically treating a substrate, the method comprising the steps of:

(a) providing a substrate for mechanical treatment, the substrate selected from the group consisting of a rigid disk or a rigid disk substrate;

(b) providing an abrasive article that is free of abrasive particles, the abrasive article comprising:

a backing having a first major surface and a second major surface; and an abrasive coating consisting essentially of:

a hardened binder coating having a first surface adhered to the backing and a second structured surface comprising a plurality of precisely-shaped protrusions; and a diamond-like carbon coating superposed and adhered to at least a portion of the structured surface of the hardened binder coating;

(c) contacting the abrasive article and substrate at a pressure; and (d) moving at least one of the substrate and the abrasive article relative to the other to provide the mechanical treatment.

2. The method of claim 1, wherein the mechanical treatment is texturing, buffing, or cleaning.

3. The method of claim 1, wherein the substrate is a rigid disk substrate comprising a metal base having opposite major surfaces and a metal coating formed on at least one of the major surfaces.

4. The method of claim 1, wherein the substrate is a rigid disk substrate comprising glass or ceramic.

5. The method of claim 1, wherein the substrate is circular having a center and wherein step (c) comprises rotating the substrate about the center to form substantially circumferential scratches in the substrate.

6. The method of claim 1, further including the step of: introducing a liquid between the abrasive article and the rigid disk or rigid disk substrate.

7. The method of claim 1, wherein step (c) comprises oscillating the abrasive article in a direction substantially perpendicular to a direction of travel of the substrate.

8. The method of claim 1, wherein said plurality of precisely-shaped protrusions have shapes selected from the group consisting of cubes, prisms, cones, truncated cones, pyramids, and truncated pyramids.

9. The method of claim 1, wherein said backing has a machine direction axis and opposite side edges, each side edge being parallel to said machine direction axis, wherein said structured surface comprises a plurality of parallel elongate ridges deployed in fixed position on said backing, wherein each of said ridges intersects said side edges at an angle from about 0 degrees to about 90 degrees.

10. The method of claim 9, wherein said parallel elongate ridges each comprise a continuous protrusion of hardened binder extending continuously between the side edges of the backing.

11. The method of claim 9, wherein said protrusion is a pyramidal shape having an apex and sides, said sides intersecting at said apex to form an angle therebetween of from about 70 to about 110 degrees.

12. The method of claim 9, wherein said ridges each comprise a plurality of separate precisely-shaped protrusions aligned with transverse centers located on said machine direction axis.

13. The method of claim 12, wherein each of said protrusions comprises a pyramidal shape having at least three sides.

14. The method of claim 13, wherein said pyramidal shape comprises a truncated pyramidal shape.

15. The method of claim 1, wherein the diamond-like carbon coating has a thickness ranging from about 5 nm to 1 micrometer.

16. The method of claim 1, wherein the diamond-like carbon coating has a plasmon energy greater than about 26 eV.

17. The method of claim 1, wherein the backing is polyethylene terephthalate film having a thickness between about 25 and 125 micrometers.

18. The method of claim 1, wherein the binder is an acrylate or a methacrylate.

19. An abrasive article comprising:

a backing having a first major surface and a second major surface; and an abrasive coating consisting essentially of:

a hardened binder coating having a first surface adhered to the backing and a second structured surface comprising a plurality of precisely-shaped protrusions; and a diamond-like carbon coating superposed and adhered to at least a portion of the structured surface of the hardened binder coating;

wherein said abrasive article is free of abrasive particles.

20. The abrasive article of claim 19, wherein said plurality of precisely-shaped protrusions have shapes selected from the group consisting of cubes, prisms, cones, truncated cones, pyramids, and truncated pyramids.

21. The abrasive article of claim 20, wherein said backing has a machine direction axis and opposite side edges, each side edge being parallel to said machine direction axis, wherein said structured surface comprises a plurality of parallel elongate ridges deployed in fixed position on said backing, wherein each of said ridges intersects said side edges at an angle from about 0 degrees to about 90 degrees.

22. The abrasive article of claim 21, wherein said parallel elongate ridges each comprise a continuous protrusion of hardened binder extending continuously between the side edges of the backing.

23. The abrasive article of claim 21, wherein said protrusion is a pyramidal shape having an apex and sides, said sides intersecting at said apex to form an angle therebetween of from about 70 to about 110 degrees.

24. The abrasive article of claim 21, wherein said ridges each comprise a plurality of separate precisely-shaped protrusions aligned with transverse centers located on said machine direction axis.

25. The abrasive article of claim 24, wherein each of said protrusions comprises a pyramidal shape having at least three sides.

26. The abrasive article of claim 25, wherein said pyramidal shape comprises a truncated pyramidal shape.

27. The abrasive article of claim 19, wherein the diamond-like carbon coating has a thickness ranging from about 5 nm to 1 micrometer.

28. The abrasive article of claim 19, wherein the diamond-like carbon coating has a plasmon energy greater than about 26 eV.

29. The abrasive article of claim 19, wherein the backing is polyethylene terephthalate film having a thickness between about 25 and 125 micrometers.

30. The abrasive article of claim 19 wherein the binder is an acrylate or a methacrylate.

* * * * *

UNITED STATES PATENT AND TRADEMARK OFFICE

CERTIFICATE OF CORRECTION

PATENT NO. : 6,821,189 B1
DATED : November 23, 2004
INVENTOR(S) : Coad et al.

It is certified that error appears in the above-identified patent and that said Letters Patent is hereby corrected as shown below:

Column 4,
Line 12, After "pyramids" insert the following paragraph:
-- In another embodiment, the backing has a machine direction axis and opposite side edges, each side edge being parallell to said machine direction axis, wherein the structured surface comprises a plurality of parallel elongate ridges deployed in fixed position on the backing wherein each of said ridges intersects the first and side edges at an angle ranging from about 0 degrees (i.e., perpendicular to the side edge) to about 90 degrees (i.e., parallel to the side edge). --

Column 7,
Line 12, delete "(p)" and insert -- (β) --, therefor.
Line 13, delete "10" and insert -- 110 --, therefor.

Column 8,
Line 52, delete "isobomyl" and insert -- Isbornyl --, therefor.

Column 9,
Line 19, delete "8045" and insert -- 80-45 --, therefor.

Column 11,
Line 21, delete "Polvmer" and insert -- Polymer --, therefor.

Column 16,
Line 55, delete "UACRI" and insert -- UACR1 --, therefor.

Column 17,
Line 55, delete "Bumisher" and insert -- Burnisher --, therefor.

UNITED STATES PATENT AND TRADEMARK OFFICE

CERTIFICATE OF CORRECTION

PATENT NO. : 6,821,189 B1
DATED : November 23, 2004
INVENTOR(S) : Coad et al.

It is certified that error appears in the above-identified patent and that said Letters Patent is hereby corrected as shown below:

Column 18,
Line 28, delete “nil/min” and insert -- ml/min --, therefor.
Line 63, delete “P11” and insert -- Pl1 --, therefor.

Signed and Sealed this

Nineteenth Day of July, 2005

JON W. DUDAS
*Director of the United States Patent and Trademark Office*